US008092040B2

(12) United States Patent
Wu et al.

(10) Patent No.: US 8,092,040 B2
(45) Date of Patent: Jan. 10, 2012

(54) MULTI-DIRECTIONAL LIGHTING FIXTURE

(75) Inventors: Arthur Y. Wu, Portland, OR (US); James A. Doerr, Richmond, VA (US); Michael D. Garten, Charlotte, NC (US); David Rector, Spokane Valley, WA (US); Virginia L. Broadbooks, Hendersonville, NC (US); Dawn R. Kack, Landrum, SC (US)

(73) Assignee: Hubbell Incorporated, Shelton, CT (US)

( * ) Notice: Subject to any disclaimer, the term of this patent is extended or adjusted under 35 U.S.C. 154(b) by 246 days.

(21) Appl. No.: 12/491,696

(22) Filed: Jun. 25, 2009

(65) Prior Publication Data

US 2010/0002426 A1 Jan. 7, 2010

Related U.S. Application Data

(60) Provisional application No. 61/129,429, filed on Jun. 25, 2008.

(51) Int. Cl.
*F21V 21/005* (2006.01)
*F21V 21/008* (2006.01)

(52) U.S. Cl. ..... 362/223; 362/217.03; 362/219; 362/404

(58) Field of Classification Search ..... 362/217.1, 362/219, 217.03, 217.04, 217.08, 223, 147, 362/354, 404
See application file for complete search history.

(56) References Cited

U.S. PATENT DOCUMENTS 2,288,606 A * 7/1942 Callahan ..... 362/224
2,319,732 A 5/1943 Guth
3,027,451 A 3/1962 Thomsen
3,086,105 A 4/1963 Nieder-Westermann
3,120,929 A 2/1964 Henning
3,159,352 A 12/1964 Wakefield et al.
3,299,264 A 1/1967 Lipscomb
3,375,322 A * 3/1968 Serio et al. ..... 174/542
3,389,246 A 6/1968 Shemitz
4,351,017 A 9/1982 Ball
4,580,200 A 4/1986 Hess et al.
4,726,781 A 2/1988 Bernhart et al.
D344,605 S 2/1994 Aspenwall
D362,315 S 9/1995 Herst et al.
5,526,244 A * 6/1996 Bishop ..... 362/147
5,658,066 A 8/1997 Hirsch
D397,480 S 8/1998 Herst et al.
D401,000 S 11/1998 Herst
D414,580 S 9/1999 Herst
D433,177 S 10/2000 Lewis
6,193,394 B1 2/2001 Herst et al.
6,247,828 B1 6/2001 Herst
6,402,345 B1 * 6/2002 Fishman ..... 362/291
6,530,674 B2 3/2003 Grierson et al.
6,568,830 B2 5/2003 Yaphe et al.
(Continued)

*Primary Examiner* — Peggy A. Neils
(74) *Attorney, Agent, or Firm* — Garrett V. Davis; Mark S. Bicks; Alfred N. Goodman

(57) ABSTRACT

The multi-directional lighting fixture includes a lighting fixture having a substantially elongated opaque housing with first and second ends with an open top for emitting light in an upward direction and a longitudinal slot along the bottom surface of the housing extending between the first and second ends. The longitudinal slot includes a shielding material, such as a louver or cover, with a predetermined degree of light translucence. The housing has a substantially elliptical cross section tapering towards one end of the housing. The ends of the housing have elliptical translucent members that can transmit lighting horizontally and radially outward from the interior of the housing. Two or more housings can be coupled together in series.

35 Claims, 17 Drawing Sheets

U.S. PATENT DOCUMENTS 6,709,131 B1 * 3/2004 Herst et al. ..... 362/223
6,796,676 B2 9/2004 Severtson et al.
D498,018 S 11/2004 Sieczkowski
6,837,592 B1 1/2005 Dahlen
6,979,097 B2 * 12/2005 Elam et al. ..... 362/148
6,984,055 B2 1/2006 McCarthy et al.
7,494,241 B2 2/2009 McCarthy et al.
7,588,345 B1 * 9/2009 Davis et al. ..... 362/223
2005/0041432 A1 2/2005 McCarthy et al.
2009/0135590 A1 5/2009 McCarthy, III et al.

* cited by examiner

MULTI-DIRECTIONAL LIGHTING FIXTURE

CROSS REFERENCE TO RELATED APPLICATIONS

This application claims the benefit of U.S. Provisional Application No. 61/129,429, filed Jun. 25, 2008. That application is hereby incorporated by reference in its entirety.

FIELD OF THE INVENTION

The present invention relates to a multi-directional lighting fixture providing upwardly-directed light, downwardly-directed light, and horizontally-directed light. The lighting fixture comprises a substantially tube-shaped housing having first and second ends with an upwardly-facing opening and a downwardly-facing longitudinal slot along the bottom surface of the housing extending between the first and second ends. The longitudinal slot includes a shielding material with a varying predetermined degree of light-translucence. The housing is further defined by a substantially elliptical cross section tapering towards one end of the housing. The ends of the housing each have an elliptical-shaped light-translucent ring that can transmit light radially outward or horizontally from the interior of the housing.

BACKGROUND OF THE INVENTION

Lighting fixtures suspended from ceilings or supported on walls typically provide indirect light upwardly, also know as uplight. Other lighting fixtures are known that provide direct light downwardly, also known as down-light. In addition, lighting fixtures can supply light in a horizontal direction, also known as semi-direct light.

Typically, prior art light fixtures provide uplight, down-light or semi-direct light, but not all three. This limits the areas to be illuminated by one fixture and requires multiple fixtures.

Prior art light fixtures also typically have light transmitting properties that are fixed due to the use of the pre-defined translucency of the lenses or diffusers.

In addition, prior art light fixtures typically have numerous parts including housings, lenses, brackets and fasteners which complicate and increase the costs of manufacture, installation, use and repair.

Examples of known prior art lighting fixtures delivering light in various directions are disclosed in the following U.S. Pat. Nos. D127,398 to Jordan; D274,657 to Herst et al.; D344,605 to Aspenwall; D401,000 to Herst; D414,580 to Herst; D463,058 to Nourishad; D498,018 to Sieczkowski; D550,881 to Lay et al.; 2,304,202 to Pracht; 2,348,930 to Schepmoes; 2,401,635 to Guth; 4,246,629 to Marrero; 4,507,719 to Quiogue; 4,573,111 to Herst et al.; 4,748,547 to Baker; 4,866,584 to Plewman; 6,305,816 to Corcorran et al.; 6,517,222 to Orlov; 7,156,537 to Cohrs; and 7,192,158 to Eppler, as well as Japanese patent 10241444 to Shinichi et al.

SUMMARY OF THE INVENTION

Accordingly, an object of the invention is to provide a lighting fixture providing uplight, down-light, and semi-direct, or horizontally-directed, light options.

A further object of the invention is to provide a lighting fixture having a substantially elliptical cross section, an upwardly-facing opening located between the ends to deliver light in an upward direction, and substantially elliptical shaped ends to deliver semi-direct light.

Another object of the invention is to provide a lighting fixture having a longitudinal slot in the bottom extending between first and second ends with a shielding material for providing downlight.

Still another object of the invention is to provide a lighting fixture having ends having a predetermined degree of translucence that can vary from a dull glow to complete opacity.

Yet a further object of the invention is to provide a lighting fixture that is made of a minimum number of parts and that can be mounted in series in a row mount, stand alone suspension, or wall mount.

Another object of the invention is to provide a lighting fixture that can be assembled with a row mount comprising a variety of housings aligned end-to-end. The fixture can have, for example, a plurality of 4-foot housings, 8-foot housings, elongated oval 4-foot housings, or a combination thereof.

The foregoing objects are attained by providing a lighting fixture comprising an elongated opaque housing having light-emitting lamps received therein and first and second ends. The housing has a longitudinal slot along the bottom surface of the housing extending between the first and second ends and providing downlight. The longitudinal slot can include a shielding material with a predetermined degree of light translucence that can be selected based on the lighting needs. The housing has a substantially elliptical-shaped cross section and tapers towards one end of the housing. The ends of the housing have elliptical-shaped translucent rings that can transmit light radially outward or horizontally from the interior of the housing. The housing has an open top to direct light in an upward direction.

The foregoing objects are further attained by providing a lighting fixture comprising an elongated housing having an open top, first and second ends, at least one lamp received therein, and an outer shell forming an outer surface of the housing. A light emitting end cap is coupled to the first end of the housing and is adapted to emit light from the at least one lamp. A longitudinal slot in a bottom surface of the housing is adapted to emit light therefrom. The longitudinal slot has a width less than a width of the open top, and where the amount of light emitted from the open top is greater than the amount of light emitted through the slot.

The foregoing objects are still further attained by providing a lighting fixture assembly comprising a first elongated housing having an open top, first and second ends and at least one lamp received in the housing. An opaque outer shell extends between the first and second ends with an opening along a bottom surface. The lamp emits light from the open top and the opening in the shells. A second elongated housing has an open top, first and second ends, at least one lamp received in the housing and an opaque outer shell extending between the first and second ends with an opening along a bottom surface of the outer shell. The lamp emits light from the open top and opening in the outer shells. The first end of the first housing is coupled to the first end of the second housing. A first translucent member is disposed at the second end of the first housing and a second translucent member is disposed at the second end of the second housing. The first and second translucent members emit light from the at least one lamp.

By forming the multi-directional lighting fixture in this manner, the housing can emit lighting in a direct, indirect, and semi-direct manner.

As used in this application, the terms "top", "bottom", and "side" are intended to facilitate the description of the lighting fixture, and are not intended to limit the description of the lighting fixture to any particular orientation.

Other objects, advantages, and salient features of the present invention will become apparent from the following detailed description, which, taken in conjunction with the annexed drawings, discloses preferred embodiments of the invention.

BRIEF DESCRIPTION OF THE DRAWINGS

Referring to the drawings which form a part of this disclosure.

DETAILED DESCRIPTION OF THE INVENTION

Figure 1:
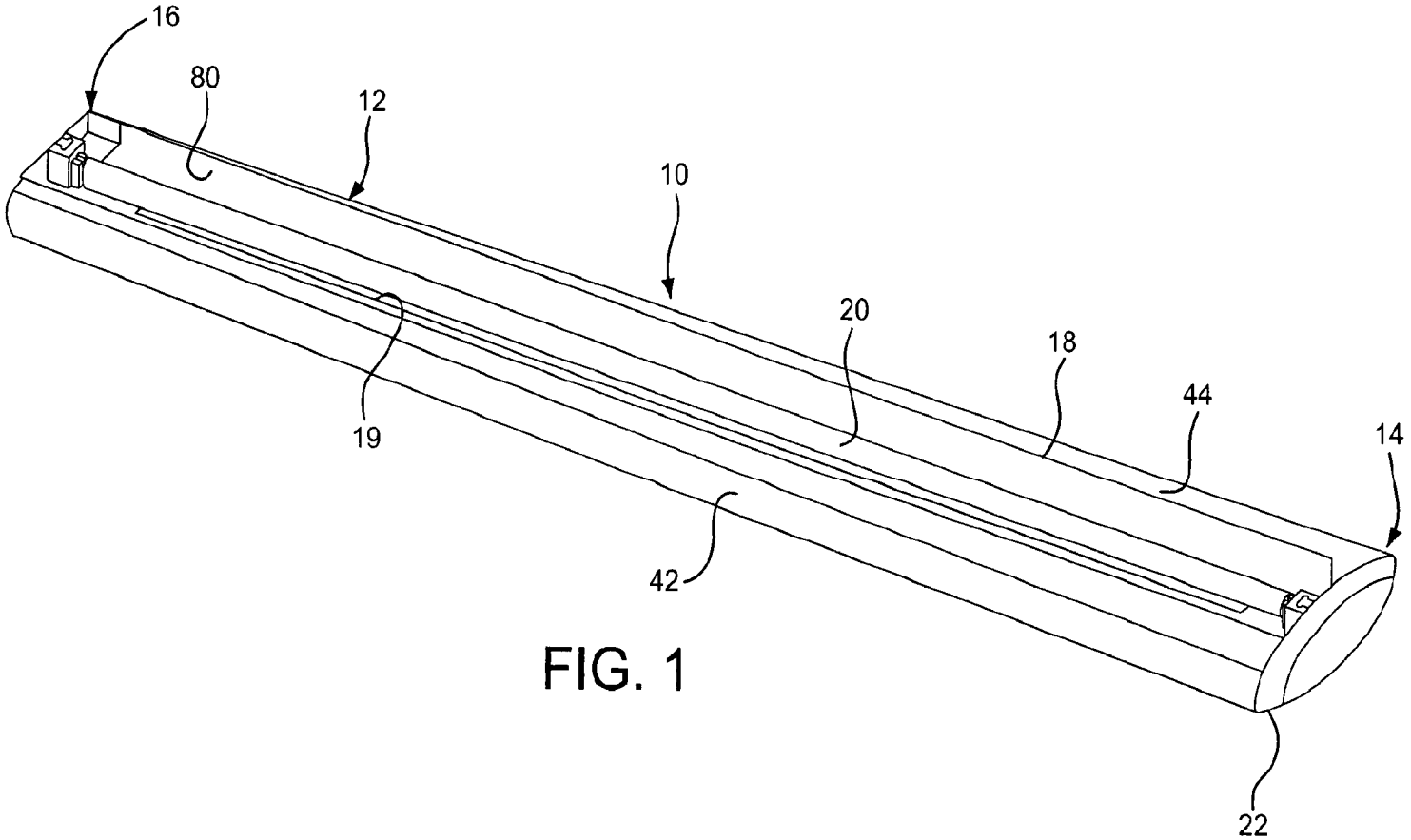
FIG. 1 is a top perspective view of the multi-directional lighting fixture according to a first embodiment of the present invention.

In a first embodiment shown in FIGS. 1-11, the multi-directional lighting fixture 10 comprises a housing 12 having a first end 14 and a second end 16 with an open top end 18 for emitting light in an upward direction from a lamp 20 positioned therein. In the embodiment illustrated, a light emitting member or end cap 22 is coupled to end 14 for emitting semi-direct light therefrom.

Lighting fixture 10 is primarily an uplight for directing light upwardly toward a ceiling or other reflective surface to provide indirect lighting to an area. In the embodiment of FIGS. 1-11, light fixture 10 has a longitudinal dimension that is tapered from first end 14 to second end 16.

The housing 12 is manufactured of a plastic material or similar substance such that the housing 12 is opaque so as not to transmit light from lamp 20 through the outer surface. The housing 12 is preferably opaque to light but can also have a selected degree of translucence so that it appears to glow.

The top of the housing 12, seen in FIGS. 1, 2, 4 and 5, includes a substantially rectangular-shaped open top end 18 to allow for uplighting from the interior of the housing 12. With this feature, the housing 12 can be suspended from a ceiling via cables or other supports such that light can be transmitted from the top opening 18 towards the uppermost area of a room. Lamps 20 are coupled to suitable lamp bases or sockets 17 located inside the housing 12.

Figure 5:
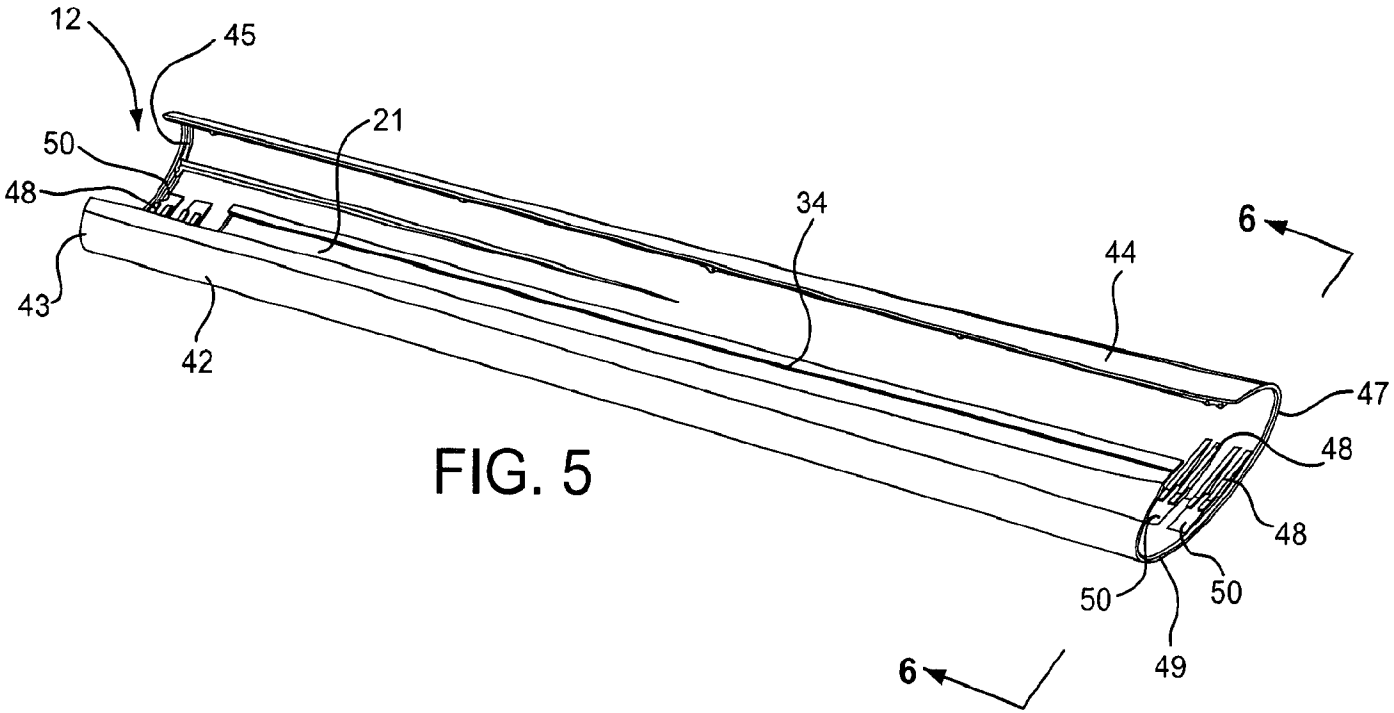
FIG. 5 is a top perspective view of the shell portion of the housing as seen in FIGS. 1-4.

The housing 12 includes a longitudinal bottom slot 34, seen in FIG. 5, extending between the first and second ends 14, 16 formed by an opening 21 between two outer shells 42, 44. More specifically, the longitudinal slot 34 extends along a bottom surface 46 of the housing 12 for emitting light in a downward direction through a shielding material such as a louver or cover. The slot 34 is substantially rectangular having a length less than that of the outer shells 42, 44 and has a width less than the width of the open top end 18.

Light transmitted through the longitudinal slot 34 provides downwardly directed light, while light transmitted through end caps 22 provides semi-direct or horizontally directed light. The longitudinal slot 34 is capable of receiving a shielding material that can be opaque to light or can be transparent with predetermined degrees of translucence. If the slot 34 is covered by a shielding material that has a selected degree of translucence, the housing 12 lighting can provide both direct and indirect lighting. In the embodiment shown, a shielding material is in the form of a louver 36 to control the amount of light being directed downward and the direction of the light emitted from slot 34.

The louver 36 is positioned in the opening 21 between the first and second shells 42, 44 and adapted to emit light therefrom. More particularly, the louver 36 is positioned in the opening 21 between the shells 42, 44 and extends between the first and second ends 14, 16 of the housing 12.

Figure 6:
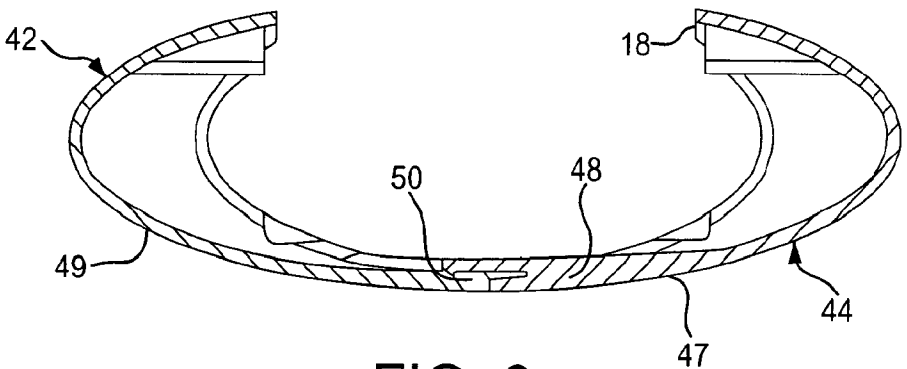
FIG. 6 is a sectional view of the lighting fixture as seen in FIG. 5.

The outer surface of the housing 12 is formed by first and second opaque shells 42, 44 extending between ends 14, 16. Each of the shells 42, 44 includes a plurality of attachment members extending outwardly from one side edge of the shell towards the opposing side edge of the other shell at both ends 14, 16. In the embodiment illustrated, shell 42 has fingers 48 at a first end 43 and shell 44 has complementary fingers 50 at a first end 45 that interlock with fingers 48, as seen in FIGS. 5 and 6. Shell 44 has a second end 47 with fingers 48 that interlock with fingers 50 at a second end 49 of shell 42.

In one embodiment, the outer shells 42, 44 can be opaque having any desirable color and any shape to define the overall shape and appearance of the light fixture 10. In the embodiment shown, the main body 83 has a substantially rectangular shape and the outer shells 42, 44 have a tapered shape. In other embodiments, the outer shells can be straight, formed with concave sides that taper or curve towards the middle, or convex sides that are tapered towards the outer ends. In a similar manner, the outer shells can have a cross-sectional shape that is round, square, rectangular, scalloped, or other suitable shape. Regarding material, the outer shells 42, 44 can be made of plastic, metal, or other suitable material.

Figure 2:
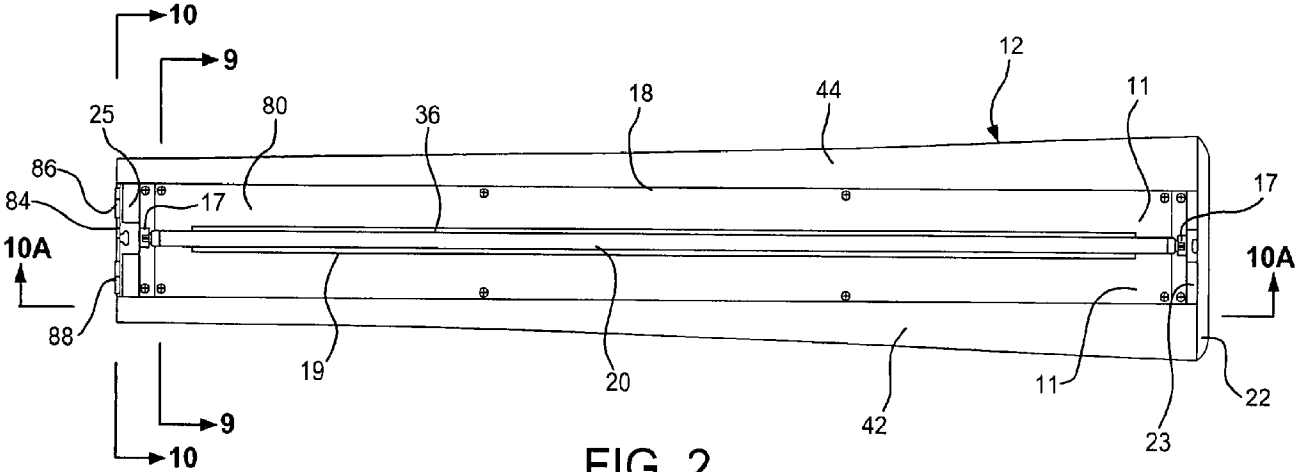
FIG. 2 is a top plan view of the lighting fixture as seen in FIG. 1.
Figure 3:
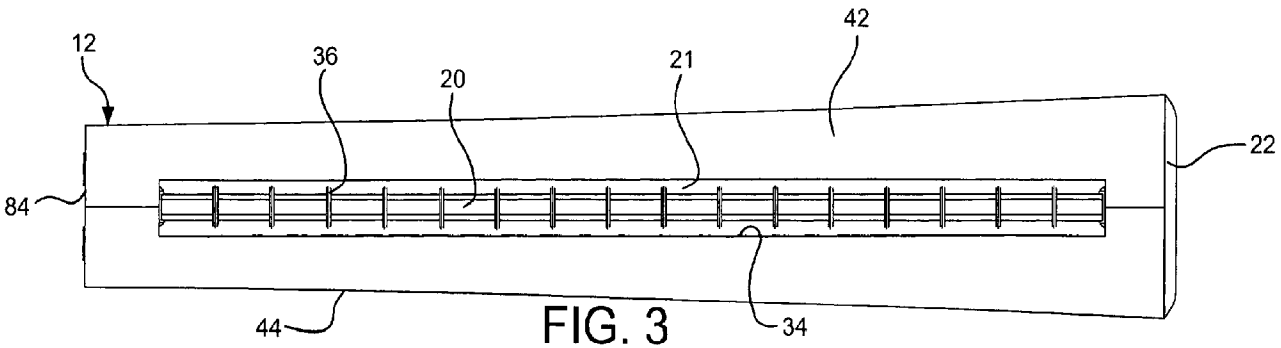
FIG. 3 is a bottom plan view of the lighting fixture as seen in FIGS. 1 and 2.
Figure 4:
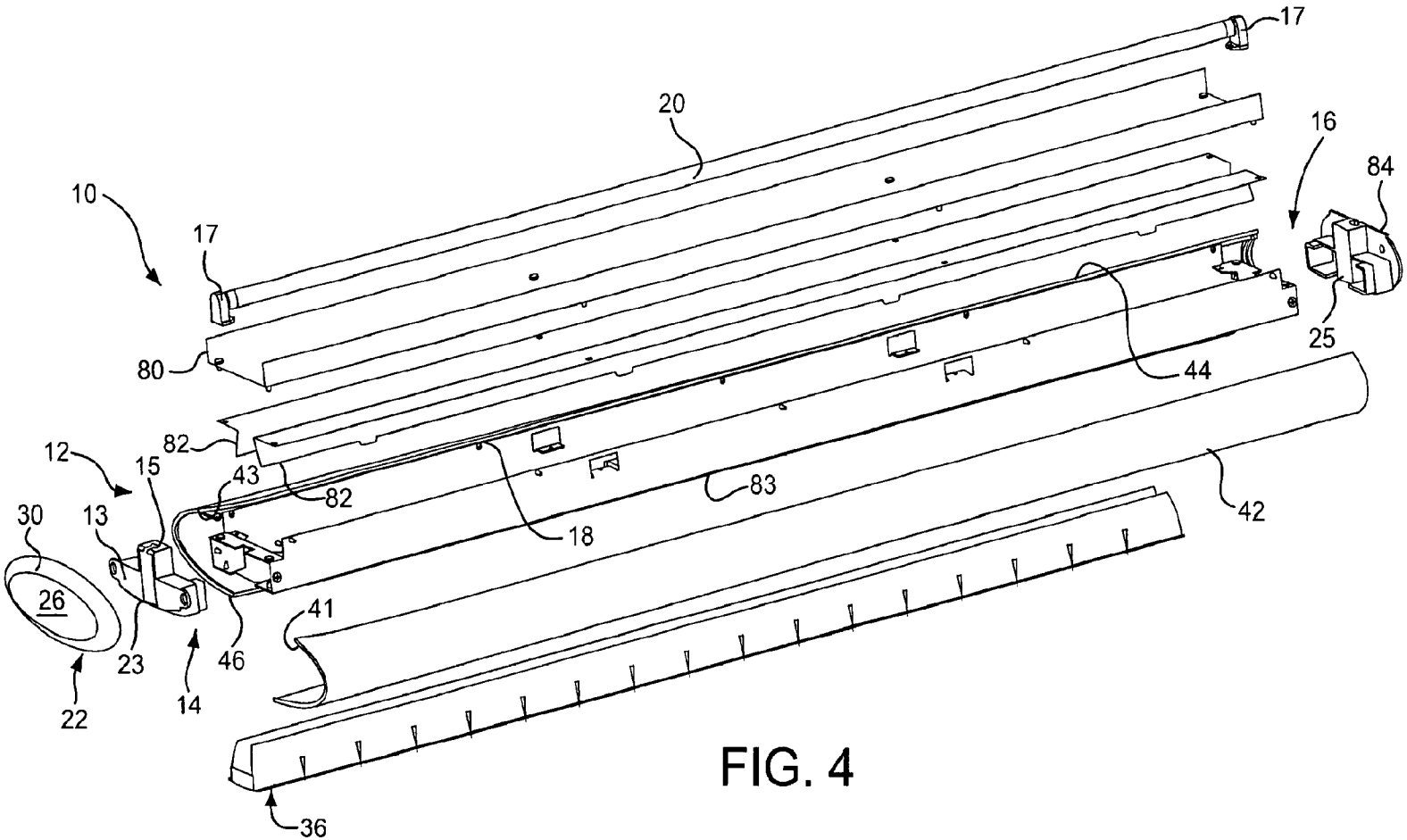
FIG. 4 is an exploded top perspective view of the lighting fixture as seen in FIGS. 1-3.

As seen in FIGS. 2 and 4, the housing 12 also includes a reflector pan 80, ballast enclosure covers 82, and a main body 83. The ballast enclosure covers 82 are attached to the reflector pan 80 with screws. A ballast is then secured to the main body 83 with the ballast enclosure covers 82. Once the ballast is attached, the reflector pan 80 is installed above the ballast enclosure covers 82, essentially sandwiching the ballast enclosure covers 82 between the main body 83 and the reflector pan 80. Finally, the lamp 20 is attached to the lamp bases 17 within the reflector pan 80 adjacent a longitudinal slot 19 in the reflector pan 80 and the open top end 18 of the housing 12.

In the embodiment of FIGS. 1-11, at least one end 14, 16 includes an elliptical-shaped end cap 22 that can be translucent to light or transparent. As shown in FIGS. 1-4, first end 14 includes end cap 22 and second end 16 is open for coupling with an adjacent light fixture. End cap 22 is coupled to first end 14 of the housing 12. In one embodiment, end cap 22 has an opaque center portion 26 to define a transparent or translucent ring-shaped outer edge 30. The outer edge 30 permits light to escape from inside the housing 12 through end cap 22 in a predetermined amount ranging from a dull glow to completely transparent to provide limited direct lighting. The amount of light emitted from end cap 22 is determined in part by the degree of translucence of the end cap 22. Optionally, the outer edge 30 can be transparent or translucent and adapted to provide semi-direct light. Alternatively, end cap 22 can be opaque so that no light passes or have a small degree of translucence to provide a glowing visual appearance.

By using this construction of the housing 12, the fixture is formed of a minimum number of parts including the housing 12, shielding material positioned in opening 21, and end cap 22 without costly brackets and fasteners. The shielding material and end cap 22 can be coupled to the housing 12 simply via an adhesive or snap-fit. The outer shells 42, 44, being made of plastic, can simply be formed as a one-piece, integrally molded member with slot 34 and recesses for the end cap 22 formed therein. End cap 22 can be separately formed and coupled to the housing 12 via suitable means, such as adhesive, fasteners, or a snap-fit.

Figure 7:
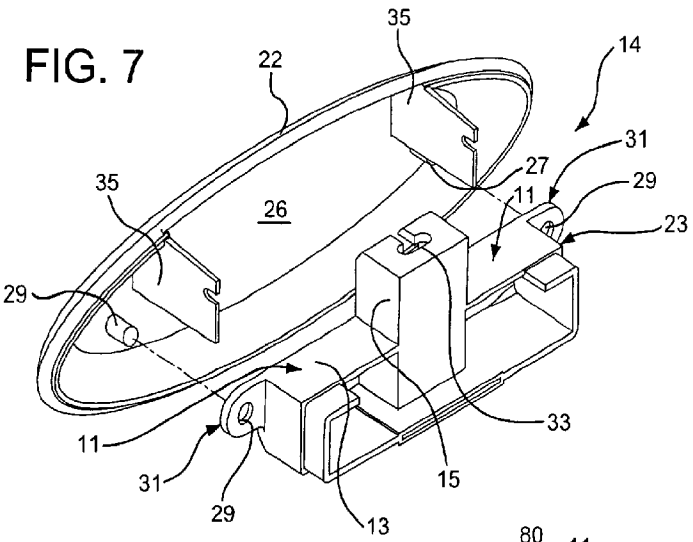
FIG. 7 is a side perspective view of an end connection for the lighting fixture as seen in FIGS. 1-6.
Figure 8:
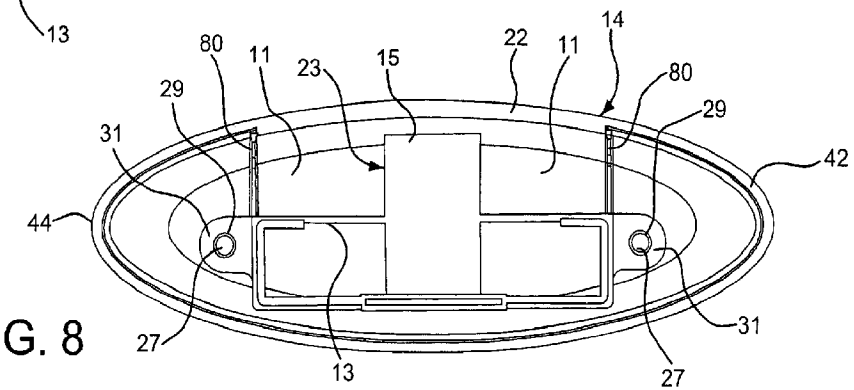
FIG. 8 is a sectional end view of the end connection as seen in FIG. 7.
Figure 9:
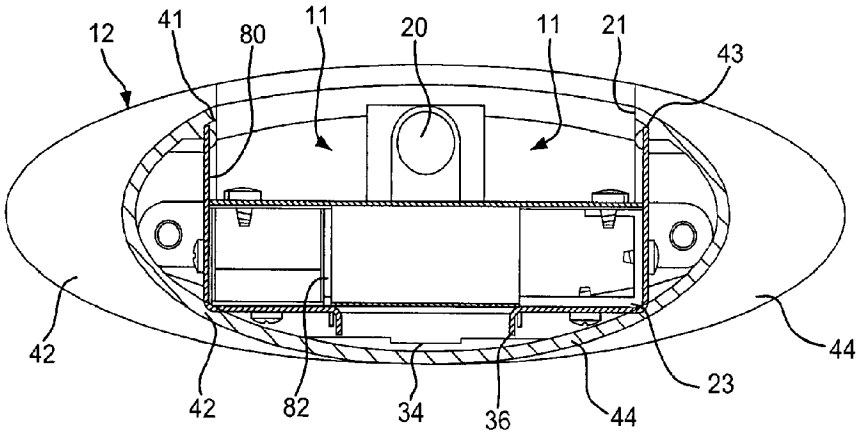
FIG. 9 is a sectional end view of the lighting fixture as seen in FIG. 2 along the line 9-9.

Housing 12 includes inner end caps 23, 25 as shown in FIGS. 4, 7 and 8. Reflector pan 80, ballast covers 82 and main body 83 are coupled to each end cap by screws. Outer shells 42, 44 are snapped together and attached to the main body along the upper edges 41, 43 of the outer shells 42, 44, respectively, as shown in FIGS. 8 and 9. In the embodiment of FIGS. 1-11, inner end cap 23 has a main body portion 13 having a width corresponding to the inner dimension of shells 42, 44 and an upwardly extending portion 15 having a height corresponding to the height of the shells 42, 44. Upwardly extending portion 15 defines open areas 11 aligned with the cavity of reflector pan 80 as shown in FIGS. 7 and 8.

Figure 11:
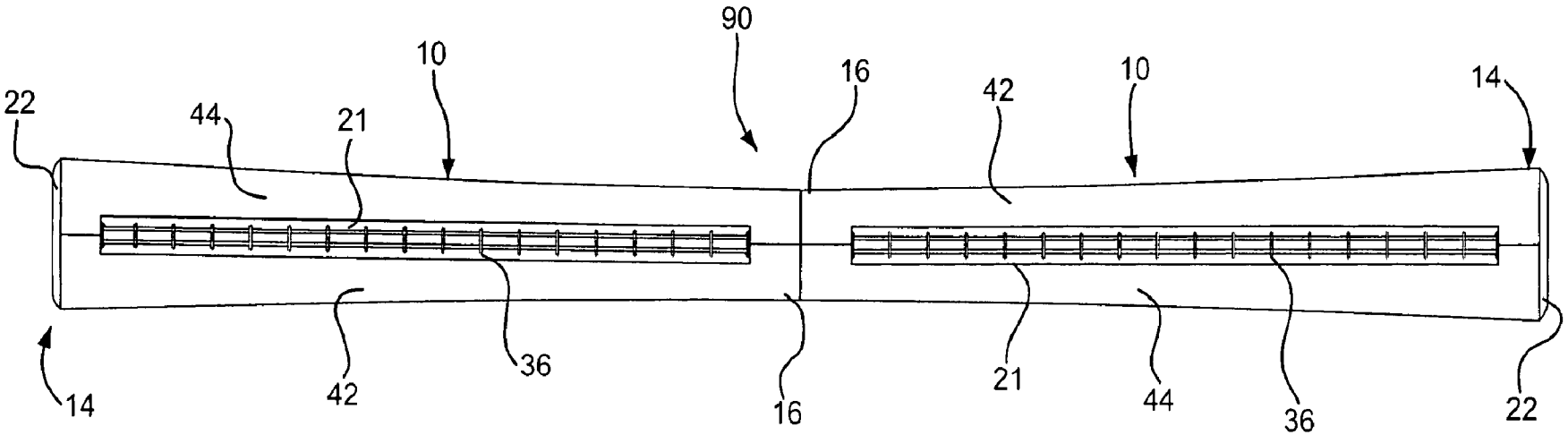
FIG. 11 is a top plan view of the lighting fixture according to a second embodiment of the present invention.

A portion of the light from lamp 20 is able to pass through the open areas 11 to the end cap 22 to illuminate end cap 22. Inner end cap 25 has a similar shape and is provided with an end wall 84 for coupling with an inner end cap of an adjacent light fixture when the light fixtures are coupled together in series, as shown in FIG. 11.

Referring to FIGS. 7 and 8, end cap 22 has an inner surface with a pair of prongs 27 and flat planar tabs 35. Main body portion 13 of inner end cap 23 has two outwardly extending tabs 31 with apertures 29 to receive prongs 27 and secure end cap 22 to inner end cap 23 by a friction fit, adhesive or other bonding means. Tabs 35 of end cap 22 align with the top edge of main body portion 13 as shown in FIG. 8. The top edge of the upwardly extending portion 15 has a T-shaped aperture 33 for receiving a cable or other mounting device for suspending light fixture 10.

Figure 10:
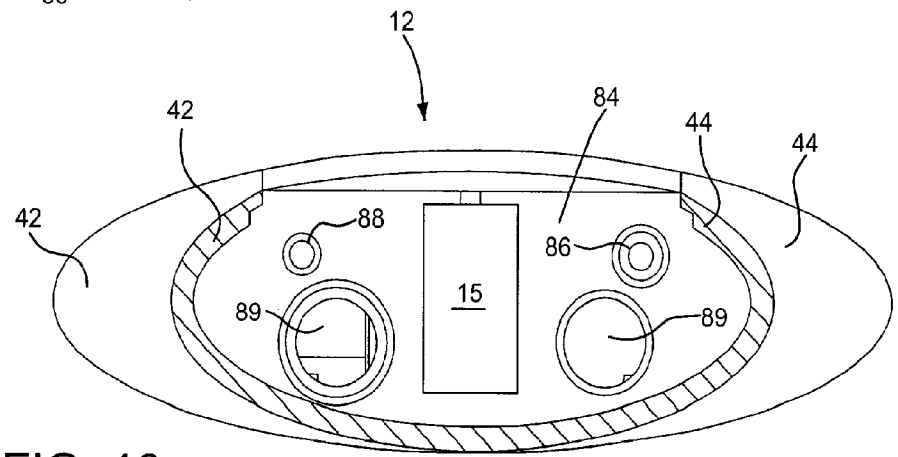
FIG. 10 is a sectional end view of the lighting fixture as seen in FIG. 2 along the line 10-10.
Figure 10A:
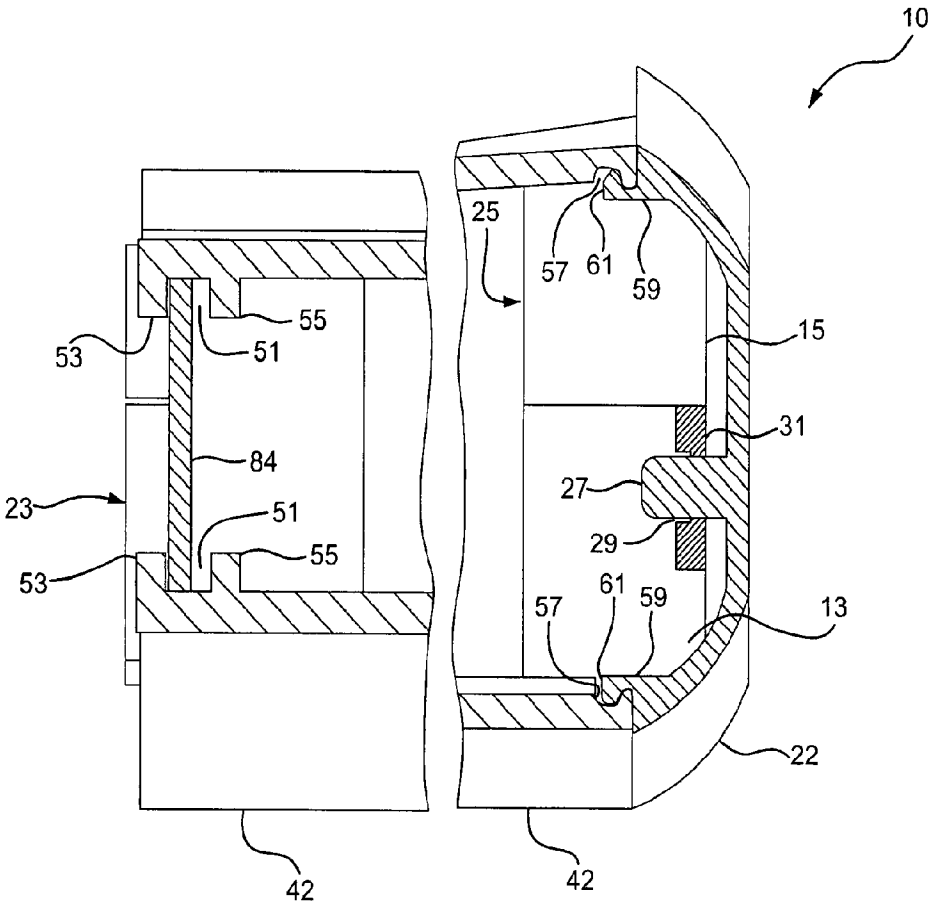
FIG. 10A is a sectional end view of the lighting fixture as seen in FIG. 2 along the line 10A-10A.

Referring to FIG. 10A, outer shells 42, 44 are coupled to the main body and reflector pan by screws and the hooked edges on the upper portion of the shells. In the embodiments using screws or fasteners to attach the shells to the reflector pan or main body, elongated holes or slots are provided in the outer shells to allow the outer shells to float and compensate for expansion and contraction of the light fixture.

A shown in FIG. 10A, the first end of shells 42, 44 have a groove 51 formed by an outer flange 53 and an inner flange 55 extending radially inward. Outer flange 53 and inner flange 55 define groove 51 to receive the outer edge of end wall 84 of inner end cap 23 as shown in FIG. 10A. In a preferred embodiment, groove 51 has a width slightly greater than the thickness of end wall 84 to allow for expansion and contraction between the outer shells and the main body. Typically, the main body, the reflector pan, the ballast covers and the inner end caps are made of metal which undergo some thermal expansion and contraction with change in temperature. The outer shells can be made of plastic or metal having a different rate of expansion and contraction from the main body.

The second end of the shells 42, 44 have a groove 57 formed on the inner surface as shown in FIG. 10A. Preferably, the groove 57 is continuous and extends continuously around the perimeter of the shells. End cap 20 includes a flange 59 extending from the rear side along the outer edge and spaced inwardly from the outer edge of end cap 20. A lip 61 extends radially outward from the flange 59. Lip 61 has an inclined outer face and an inclined inner face forming a catch for coupling with groove 57 to couple the end cap to the shells 42, 44 in a snap connection. In the embodiment shown in FIG. 10A, prongs 27 are received in the apertures 29 of inner end cap 20 to serve as a guide for positioning the end cap on the inner end cap 15 and shells 42, 44. Prongs 27 can float within the aperture without being mechanically coupled thereto. In a preferred embodiment, end cap 20 has an outer dimension and shape corresponding to the outer dimension and shape of shells 42, 44. As shown in FIG. 10A, flange 59 is spaced inwardly from the outer edge of end cap 20 a distance corresponding to the thickness of shells 42, 44 so that the outer edges of the end cap are aligned with the outer surface of shells 42, 44. The face of end cap 20 is preferably spaced from inner end cap 15 a distance to allow expansion between the components.

In the embodiment of FIGS. 1-11, light fixture 10 is constructed primarily as an uplight to direct light upwardly and provide indirect lighting to an area below. Lamp 20 is positioned with respect to the open top end 18 to direct the light upwardly. As shown in FIG. 2, open top end 18 has a width substantially greater than the width of lamp 20. In the embodiment shown, a single lamp 20 is provided in each housing 12. In alternative embodiments, two or more lamps can be provided either adjacent each other in a side-by-side arrangement, an end-to-end arrangement, or in an over-under arrangement.

Slot 34 is provided in the bottom surface of housing 12 and is aligned with lamp 20. As shown in FIG. 5, slot 34 has a width substantially less than the width of open top end 18 so that the amount of light that can pass through slot 34 is significantly less than the amount of light passing through open top end 18. In the embodiment shown in FIG. 6, the slot in the outer shell is provided with louver 36 to direct the light passing through slot 19 in reflector pan 80 in a downward direction. Typically, the amount of light directed downwardly through slot 34 provides some semi-direct lighting with the majority of the light in the area below the light fixture 10 being provided by indirect light by reflection from the ceiling.

Referring to FIGS. 2 and 7, end cap 22 is coupled to housing 12 and is illuminated by lamp 20. In one embodiment, end cap 22 has an opaque center portion 26 with a translucent outer edge 30 so that only the outer edge 30 is illuminated. Outer edge 30 can be sufficiently translucent to provide a glow against the opaque center portion 26 and the opaque outer shell. The glowing outer edge 30 of end cap 22 can provide a decorative feature without directing a significant amount of light to the area to be illuminated. In other embodiments, the outer edge 30 and/or the center portion 26 of end cap 22 can be transparent or be sufficiently translucent to direct light outwardly to illuminate a selected area. The outer edge 30 can be sufficiently translucent to direct light radially outward from end cap 22. In still further embodiments, the outer edge 30 of end cap 22 can have translucent or transparent portions to direct light in a selected direction and have other portions of the outer edge opaque.

As shown in FIG. 11, two light fixtures 10 are coupled together to form a light assembly 90 with the opposite sides tapering inwardly toward a center of the assembly 90. In the embodiment shown, the narrow second end 16 of each light fixture are coupled together by second inner caps 25. As shown in FIGS. 2 and 10, end cap 25 has an end wall 84 with a substantially flat outer face and a pair of apertures 86, 88 extending through the end wall 84. Screws or other fasteners pass through the apertures 86, 88 of the respective inner end caps 25 to couple the inner end caps 25 together and to couple the light fixtures 10 together to form assembly 90.

As can be seen in FIG. 10, one of the apertures 86 is longer than the other 88 for nesting the inner end caps 25 of the coupled housings 10 together. With this configuration, when the inner end caps 25 are matched, aperture 86 of a first housing surrounds aperture 88 of the inner end cap 25 of the opposite housing. Aperture 88 has a smaller circumference to provide this friction fit therebetween. Apertures 89 in end wall 84 provide access openings between the adjacent light fixtures for wiring.

Figure 12:
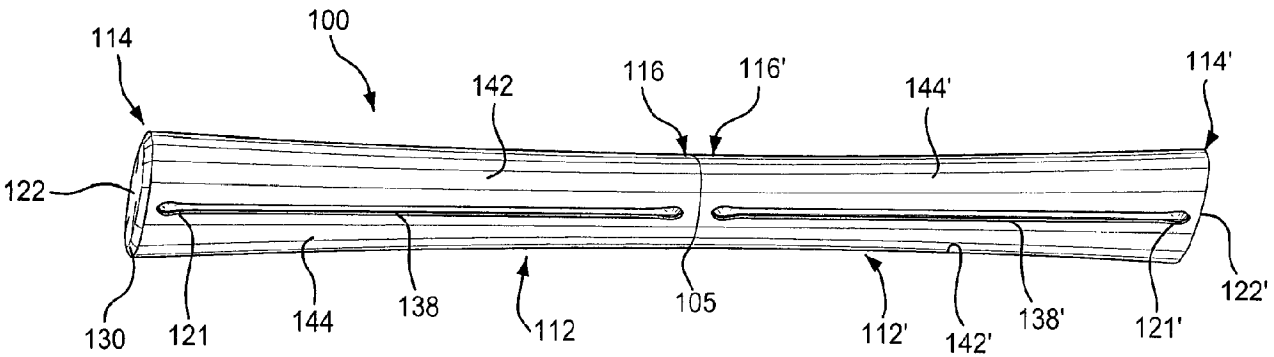
FIG. 12 is a bottom perspective view of the lighting fixture according to a third embodiment of the present invention.
Figure 13:
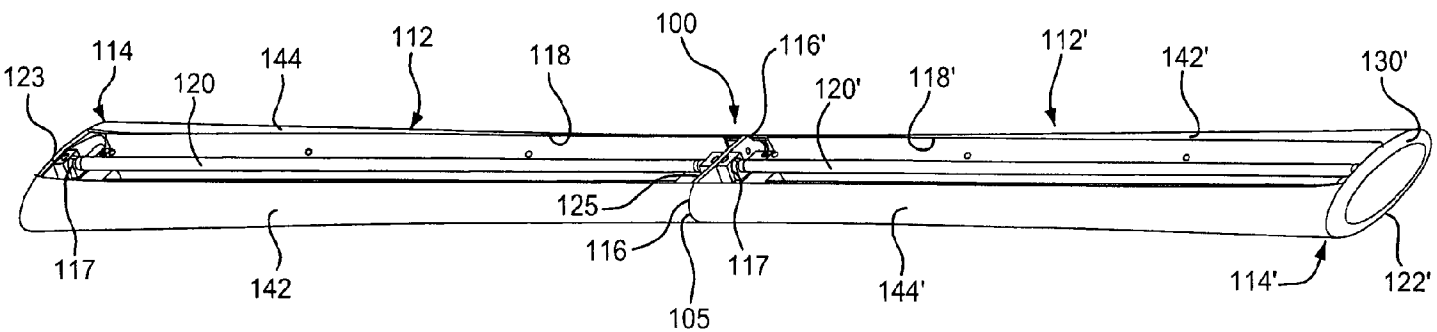
FIG. 13 is a top perspective view of the lighting fixture as seen in FIG. 12.

Turning to FIGS. 12 and 13, another embodiment of a light assembly 100 is shown constructed from at least two housings coupled together. The housings 112 are identical in structure to each other, similar to the construction of light assembly 10 illustrated in FIG. 11, with at least two housings. The first and second housings 112, 112' are connected at a midpoint 105 of the lighting fixture assembly 100. The inner end cap 125 of the first housing 112 is coupled to the inner end cap 125' of the second housing 112' to create a flush connection therebetween.

A lighting fixture assembly 100 comprises a first elongated housing 112 and a second elongated housing 112' coupled thereto. A first translucent end cap member 122 is disposed at an outer end 114 of the first housing 112 and a second translucent end cap member 122' disposed at an outer end 114' of the second housing 112' opposite the first end 114 of the first housing 112. The first and second translucent end cap members 122, 122' emit light from opposite ends of the fixture 100 in a manner similar to the previous embodiment. End caps 122, 122' form light emitting members for a selected amount of light.

The first housing 112 has an open top end 118, first and second ends 114, 116 and at least one lamp 120 received therein. The housing 112 is formed with first and second opaque outer shells 142, 144 extending between the first and second ends 114, 116. The housing 112 has an opening 121 along a bottom surface. The lamp 120 emits light from the open top 118 and through the opening 121 between the opaque outer shells 142, 144. Each of the shells 142, 144 includes a plurality of attachment members extending outwardly from one side edge of the shell towards the opposing side edge of the other shell at both ends 114, 116 in a manner similar to the previous embodiment.

The second housing 112' is identical to first housing 112 and has an open top end 118', first and second ends 114', 116' and at least one lamp 120' received therein. The housing 112' is formed with first and second opaque shells 142', 144' extending between the first and second ends 114', 116' with an opening 121' along a bottom surface therebetween. The lamp 120' emits light from the open top end 118' and through the opening 121' between the shells 142', 144'.

The housings 112, 112' are coupled together at the ends 116 and 116'. As shown in FIGS. 12 and 13, the second end 116 of the first housing 112 is coupled to the second end 116' of the second housing 112'. The light fixture assembly 100 includes translucent members at the outer ends such that a first translucent member or elliptical-shaped end cap 122 is disposed at the first end 114 of the first housing 112 and a second translucent member or elliptical-shaped end cap 122' is disposed at the first end 114' of the second housing 112'. The first and second end caps 122, 122' emit light from each of the lamps 120, 120', respectively in a manner similar to the previous embodiment.

Specifically, end caps 122, 122' can be translucent to light or transparent. End caps 122, 122' have an opaque center portion 126, shown in FIG. 16, to define a transparent or translucent ring-shaped outer edge 130. The outer edge 130 permits light to escape from inside the housing 112 by outer edge 130 having a predetermined degree of transparency or translucence to provide a range of light transmission from a dull glow to completely light transmissive. Optionally, the outer edge 130 can be transparent or translucent and adapted to provide semi-direct light. Alternatively, end cap 122 can be opaque so that no light passes. End cap 122' of the second housing 112' is similarly constructed such that semi-direct light is emitted from both ends of the lighting assembly 100.

Figure 15:
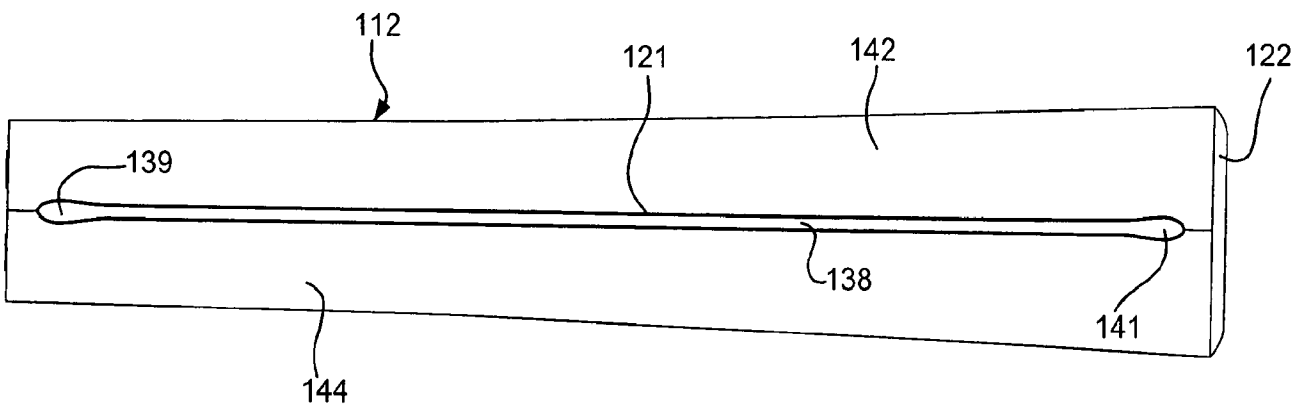
FIG. 15 is a bottom plan view of the lighting fixture as seen in FIGS. 12-14.
Figure 16:
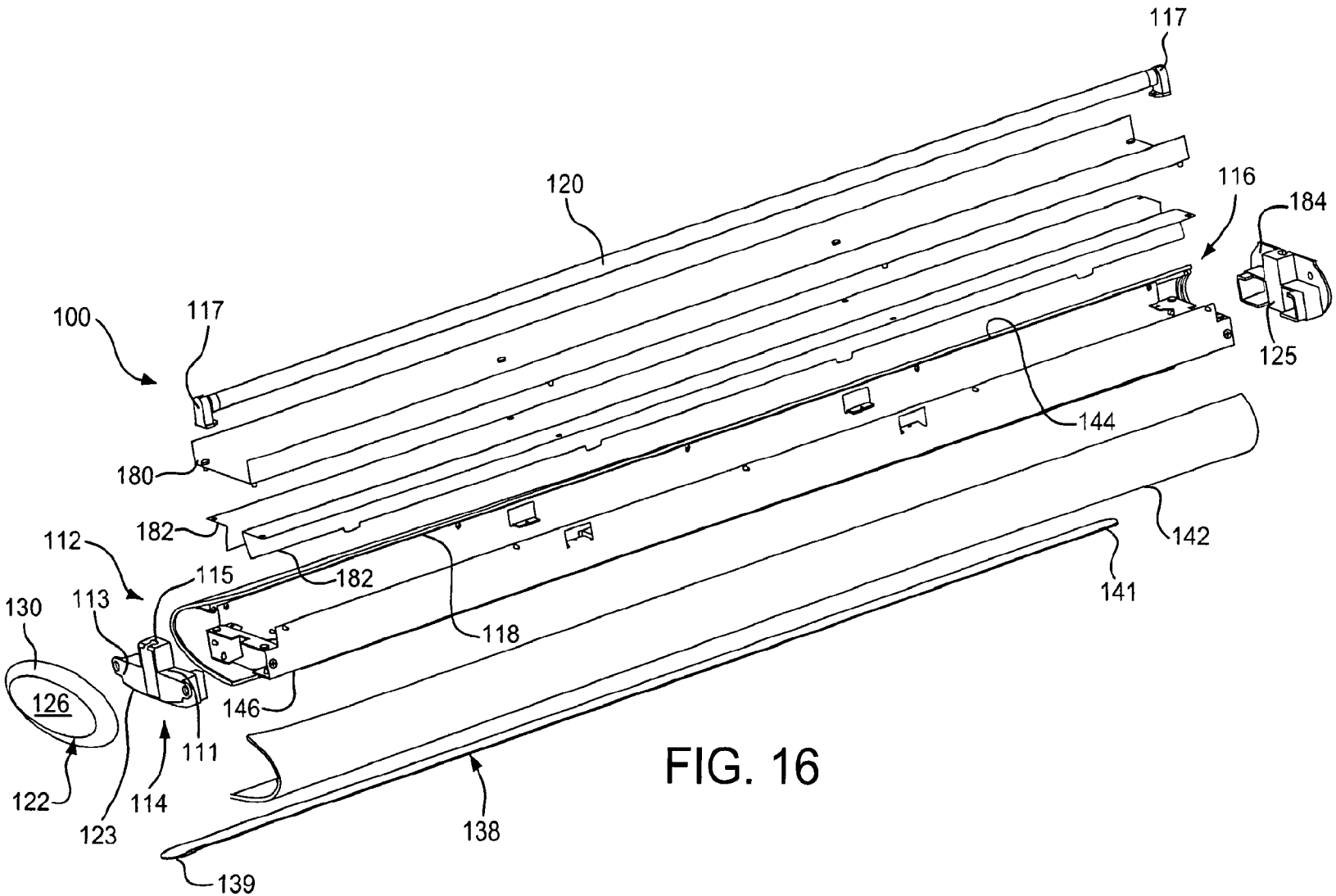
FIG. 16 is an exploded top perspective view of the lighting fixture as seen in FIGS. 12-15.
Figure 17:
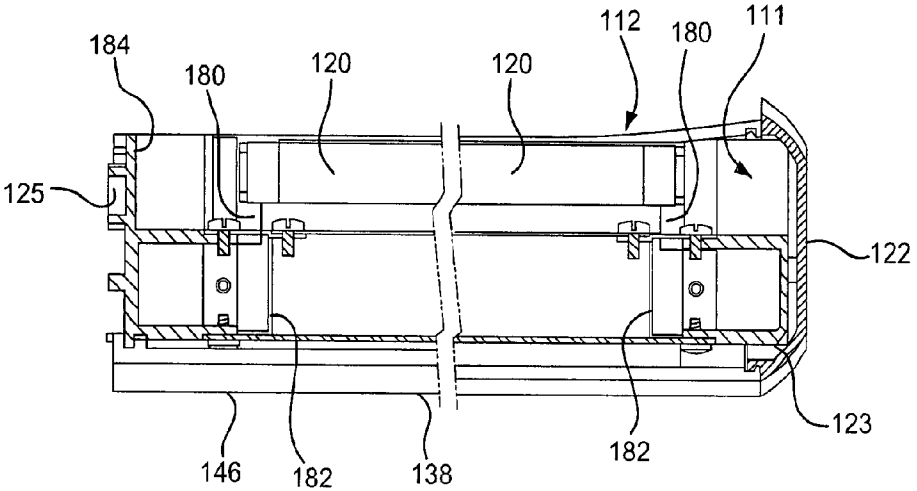
FIG. 17 is a sectional end view of the lighting fixture as seen in FIG. 14 along the line 17-17.
Figure 18:
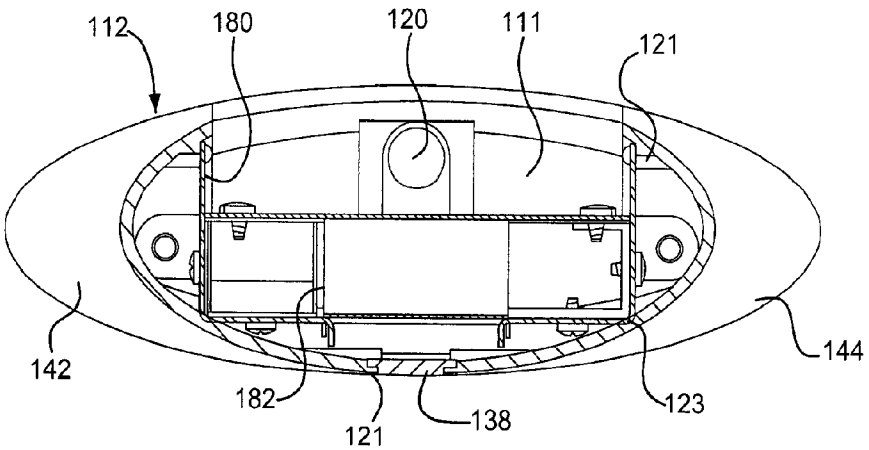
FIG. 18 is a sectional end view of the lighting fixture as seen in FIG. 14 along the line 18-18.

Each of the housings 112, 112' has a substantially elliptical-shaped cross section and are tapered towards the center of the assembly 100. A lens or diffuser 138 is positioned in the opening 121 in the bottom of each housing 112, 112' and extends between the first and second ends of each respective housing 112, 112'. The lens 138 is narrower than the width of the opening 121 and is substantially rectangular having first and second substantially oval ends 139, 141 as shown in FIGS. 15 and 16. The lens 138 directs some light from the lamps 120, 120' in a downward direction and through the opening in the bottom surface of each housing 112, 112'.

The end caps emit light in a semi-direct manner from the ends of the lighting fixture 100. Each end cap 122, 122' is substantially elliptical and attached to inner end caps 123, and the ends of the shells 142, 144, 142', 144'. The end caps 122, 122' each include an exterior translucent rim 130, 130' towards the outermost edge of the end cap 122, 122'. The rims or glow ends 130, 130' can transmit light radially outward or horizontally from the lamps 120, 120'. The rims 130, 130' have a predetermined degree of translucence that can provide a dull glow or be completely opaque. The center of the end caps 122, 122' adjacent the rims 130, 130' are opaque and do not transmit any light from the lamps 120, 120'.

As seen in FIGS. 14-19, each of the housings 112 is similar to the housing 12 described in the first embodiment with the exception of the shielding material received in the opening the bottom surface of the housing. Light fixture 100 has a longitudinal dimension that is tapered from first end 114 to second end 116. Lamps 120 are coupled to suitable sockets 117 located inside the housing 112.

The housing 112 includes a longitudinal bottom slot extending between the first and second ends 114, 116 formed by an opening 121 between two outer shells 142, 144. The slot has a length less than that of the outer shells 142, 144 and has a width less than the width of the open top end 118. In the embodiment shown, a shielding material is in the form of a lens or diffuser 138 to control the amount of light being directed downward and the direction of the light emitted from opening 121.

Figure 14:
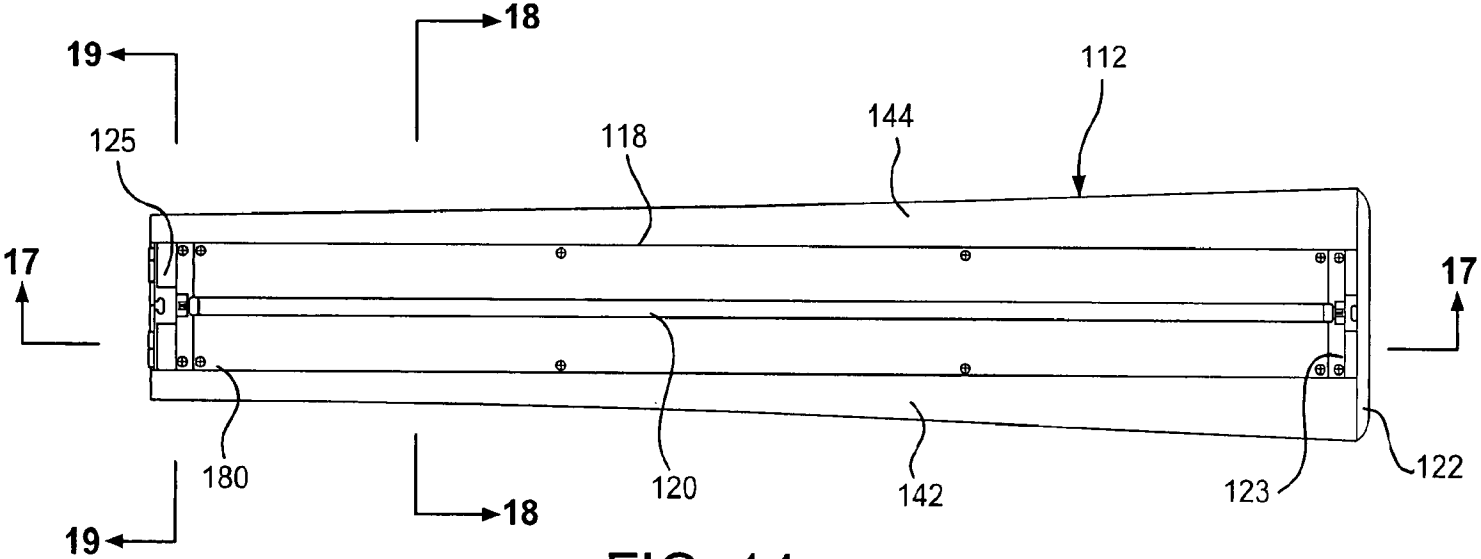
FIG. 14 is a top plan view of the lighting fixture as seen in FIGS. 12 and 13.

As seen in FIGS. 14 and 16, the housing 112 also includes a reflector pan 180, ballast enclosure covers 182, and a main body 146. The ballast enclosure covers 182 are attached to the reflector pan 180 with screws. A ballast is secured to the main body 146 with the ballast enclosure covers 182. Once the ballast is attached, the reflector pan 180 is installed above the ballast enclosure covers 182, essentially sandwiching the ballast enclosure covers 182 between the main body 146 and the reflector pan 180. The lamp 120 and lamp sockets 117 are attached to the main body 183 adjacent the open top end 118.

Housing 112 includes inner end caps 123, 125 as shown in FIG. 16. Inner end cap 125 is provided with an end wall 184 for coupling with a corresponding inner end cap of an adjacent light fixture when the light fixtures are coupled together in series, as seen in FIGS. 12 and 13. In the embodiment of FIGS. 12-22, inner end cap 123 has a main body portion 113 having a width corresponding to the inner dimension of shells 142, 144 and an upwardly extending portion 115 having a height corresponding to the height of the shells 142, 144. Upwardly extending portion 115 defines open areas 111 aligned with the cavity of reflector pan 180.

Figures 19, 20:
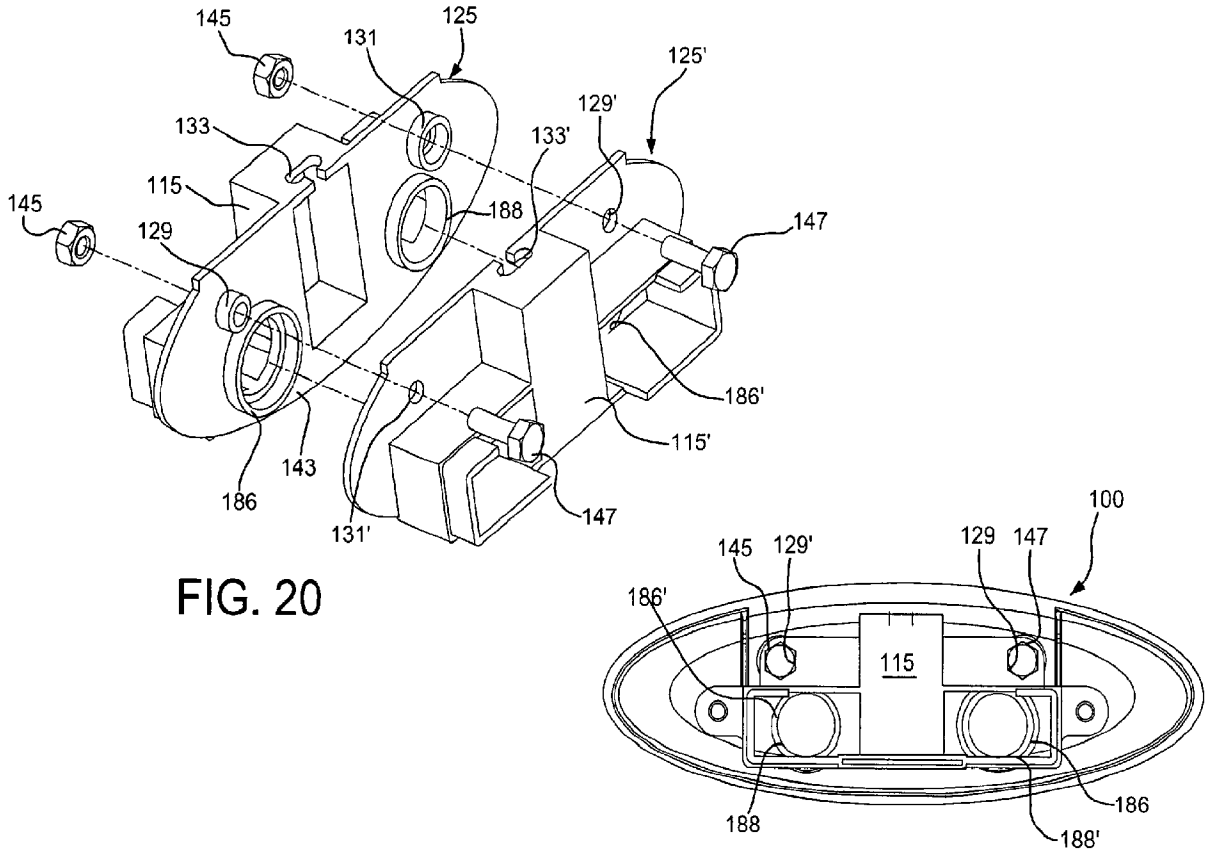
FIG. 19 is a sectional end view of the lighting fixture as seen in FIG. 14 along the line 19-19.
FIG. 20 is a side perspective view of an end connection for the lighting fixture as seen in FIGS. 12 and 13.

As shown in FIG. 20, inner end cap 125 of first housing 112 includes a first pair of annular openings 186, 188 disposed towards the lower portion 143 of the inner end cap 125 and a second pair of annular openings 129, 131 disposed towards the top of the inner end cap 125. The first pair of openings 186, 188 serve as a wire conduit for the electrical wiring between the first and second housings 112, 112'. The second pair of openings 129, 131 receive attachment members, such as nuts 145 and bolts 147, to secure the first and second inner end caps 125, 125' together. The top of each inner end cap 125, 125' includes a T-shaped aperture 133, 133', respectively, for receiving a cable or other mounting device for suspending the fixture 100.

The inner end cap 125' of the second housing 112' includes matching apertures to nest with the first and second pairs of annular openings 186, 188, and 129, 131, respectively, of the inner end cap 125 of the first housing 112. More specifically, opening 186 has a larger circumference than opening 188 such that when inner end cap 125 of the first housing 112 is flush with inner end cap 125' of the second housing 112', opening 186' faces opening 188 and opening 188' faces opening 186. With this configuration, the first pairs of annular openings are nested within each other because each smaller circumference is across from an opening with a larger circumference, as seen in FIG. 19. Inner end caps 125 and 125' are identical to be readily coupled together.

The same design exists for the second pair of annular openings 129, 131 of the first housing 112 and the second pair of annular openings of the second housing 112'. Opening 131 has a larger circumference than opening 129 such that when inner end cap 125 of the first housing 112 is flush with inner end cap 125' of the second housing 112', opening 129' faces and nests within opening 131 and opening 129 faces and nests within opening 131'.

The inner end caps 123, 225 can be made out of metal or a combination of plastic and metal. The apertures 186, 188 of the inner end cap 125 of the first housing 112' and apertures 186', 188' of the inner end cap 125' of the second housing 112' that potentially contact the electrical wires passing between the first and second housings 112, 112' must be coated with metal to comply with UL requirements.

Figure 21:
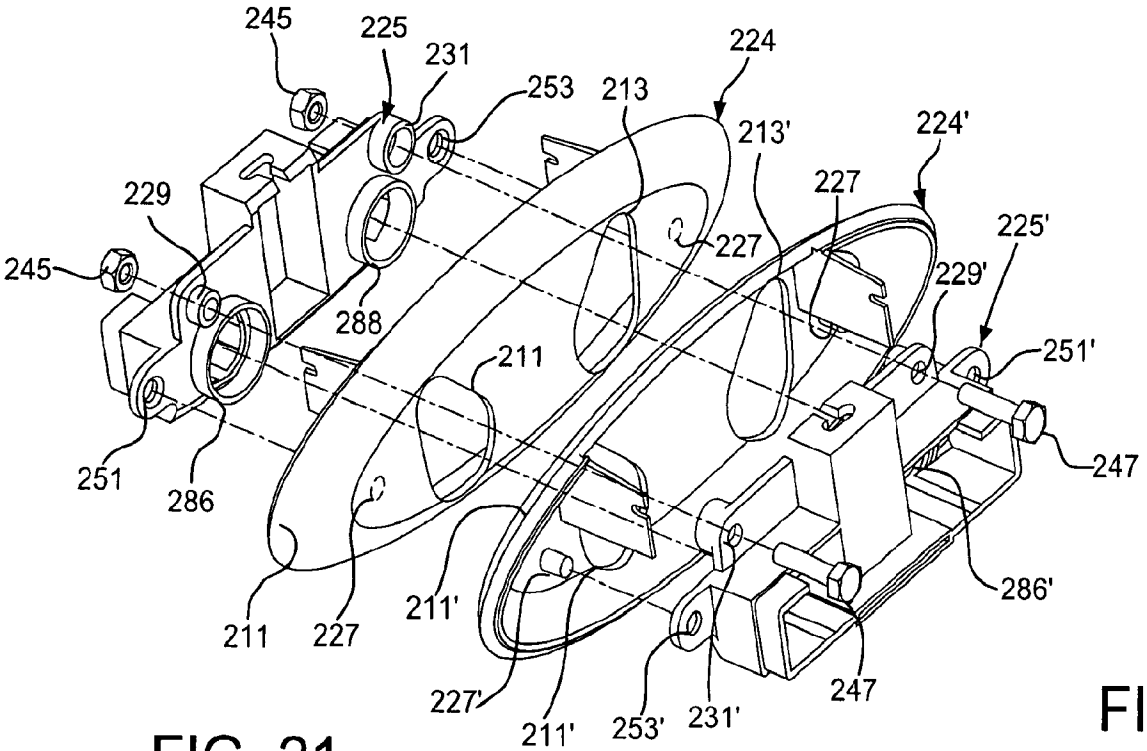
FIG. 21 is a side perspective view of an end connection for the lighting fixture as seen in FIGS. 12 and 13.
Figure 22:
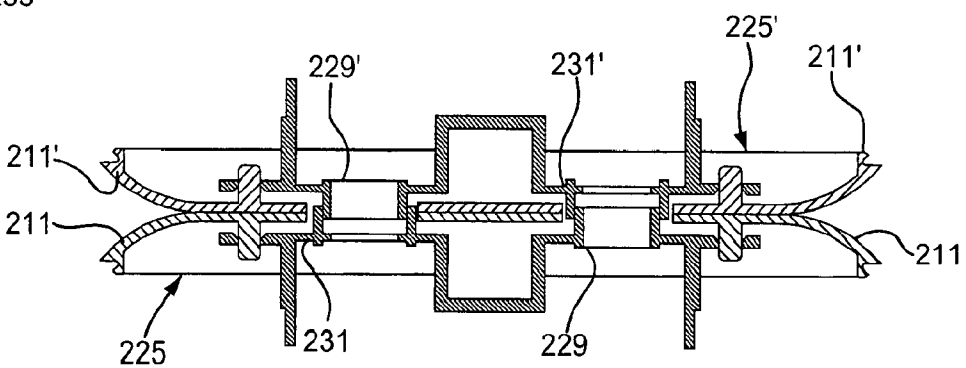
FIG. 22 is a sectional top view of the connection as seen in FIG. 21.

Another embodiment as a suitable connection between two light fixtures is shown in FIGS. 21 and 22. In this embodiment, each inner end cap 225, 225' is coupled to an outer end cap 222, 222' with ends scalloped towards the housing of the light fixture. As in the previous embodiment, each inner end cap 225, 225' includes a first pair of annular openings 286, 288 for a wiring conduit and a second pair of annular openings 229, 231 adjacent the top of the inner end cap 225, 225' for securing the connection between the first and second outer end caps 222, 222' by bolt 247 and nut 245. Each inner end cap 225, 225' also has a third pair of annular apertures 251, 253 disposed on outwardly extending tabs thereof. The third pair of apertures 251, 253 receive prongs 227 protruding from the interior surface of the outer end cap 222 adjacent inner end cap 225 to secure the inner end cap 225; and apertures 251' and 253' receive prongs 227' protruding from the interior surface of the outer end cap 222' adjacent inner end cap 225' to secure the inner end cap 225'.

In the embodiment illustrated in FIGS. 21 and 22, first and second outer end caps 222, 222' of the first and second housings are sandwiched between inner end caps 225, 225' of first and second housings thereof. The outer end caps 222, 222' are elliptically shaped corresponding to the shape of the housing of the light fixture. The outer end caps have outer edges or rings 211, 211' that can be translucent for emitting light therefrom. The outer end caps 222, 222' have teardrop shaped openings 211, 213 and 211', 213', respectively, that are large enough to accommodate the upper and lower portions of annular openings 229, 231, 229', 231'. The connection is similar to that of the previous embodiment with the nesting of the larger and smaller apertures to provide a friction fit therebetween. As such, light can be emitted from the junction between the two housings via the rings 211, 211'.

The housing of the invention can be any suitable length depending on the lighting needs. In one embodiment, the housing can be approximately 48" long and have a width ranging from 9"-11.3". The height of the housing can range from 3"-3.8". The ends 14, 16 can have a height ranging from 2"-2.6" and a width ranging from 7"-8.7". The outer dimensions of the end caps can range from 3"-3.8" in height and a width of 9"-11.3". The inner dimensions can range from 2"-2.6" in height and a width of 7"-8.7". The radial thickness can be approximately 0.50". The longitudinal slot can be approximately 0.74" wide with a riser having a thickness of approximately 0.18" and a width of approximately 0.46". The slot width can be about 1/7 to about 1/8 the width of the first end 14 and second end 16 of the housing 12 to provide a somewhat narrow downlight.

Figure 23:
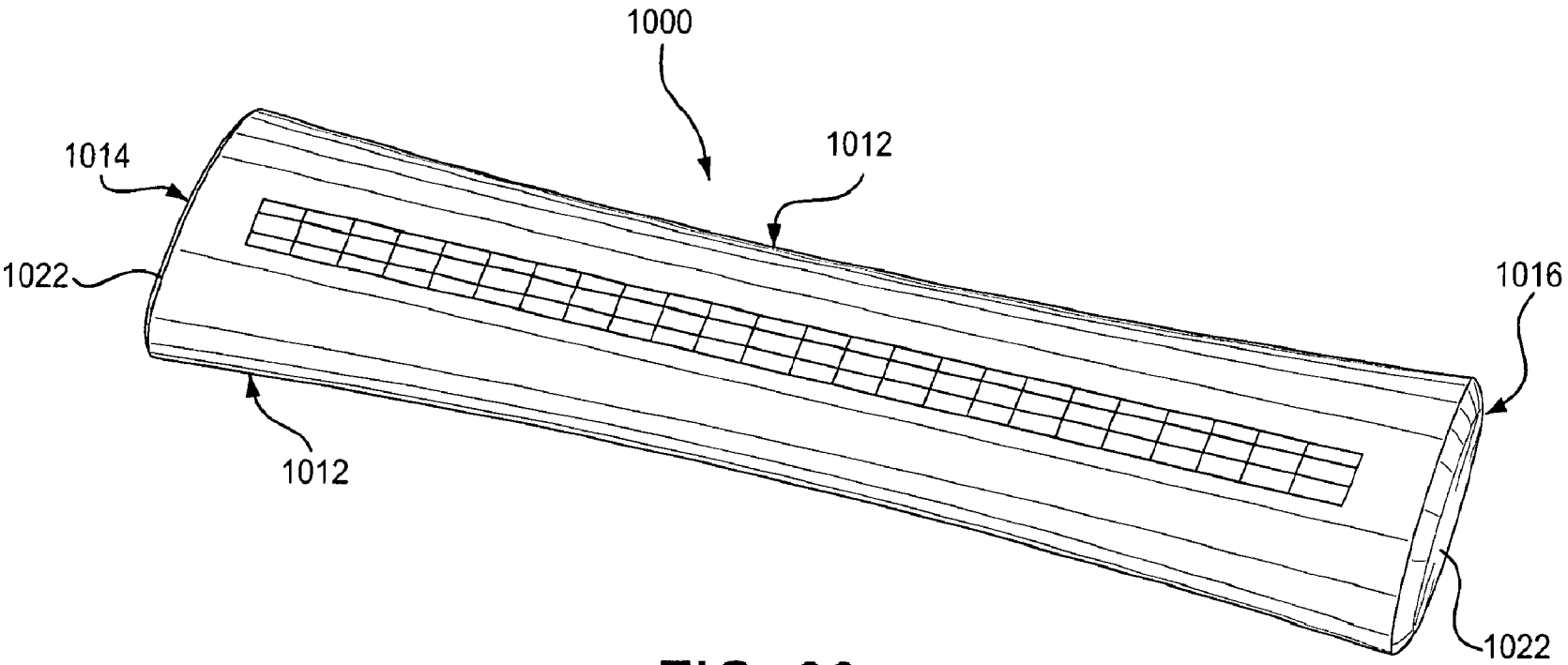
FIG. 23 is a bottom perspective view of the lighting fixture according to the fourth embodiment.
Figure 24:
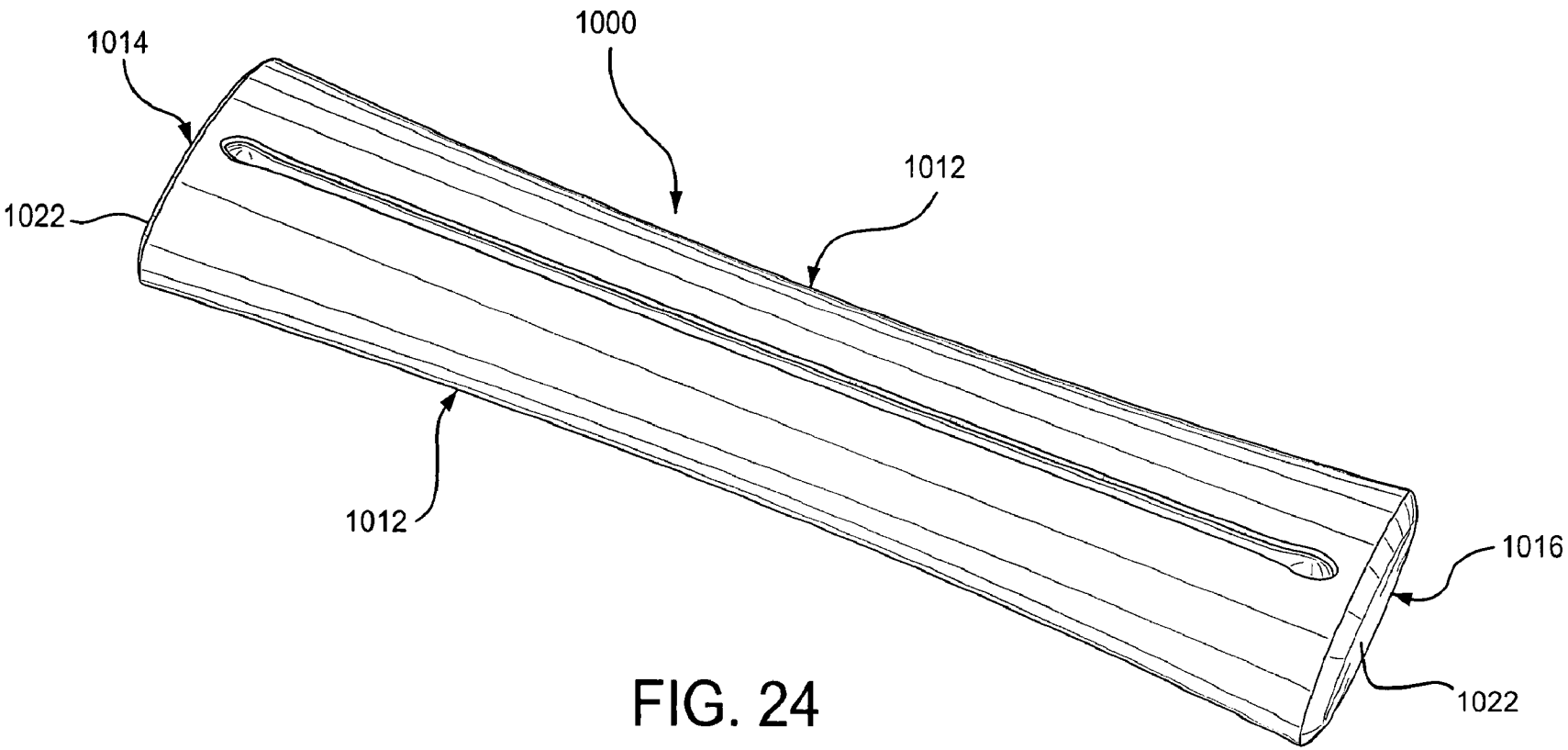
FIG. 24 is a bottom perspective view of the lighting fixture according to the fifth embodiment.

In the embodiment of FIGS. 1-11, light assembly 10 has tapered side edges so that the first end is wider than the second end. In an alternative embodiment shown in FIGS. 23 and 24, the light assembly 1000 has substantially parabolic side edges 1012 that curve inwardly toward the center. The top and bottom surfaces are substantially parallel to each other. Light assembly 1000 is constructed in a substantially similar manner as the embodiment of FIGS. 1-11 with the exception of having an end cap 1022 at each longitudinal end. Each end cap 1022 is substantially the same as end cap 22 of the embodiment of FIGS. 1-11 and can be constructed to be illuminated by the lamp.

In previous embodiments, the outer surface of the light fixture is formed by two shells snapped together and coupled to the reflector pan. In additional embodiments, the outer surface can be formed as a one piece member or formed from three or more sections that are coupled together by a suitable coupling such as snap connectors.

Figure 25:
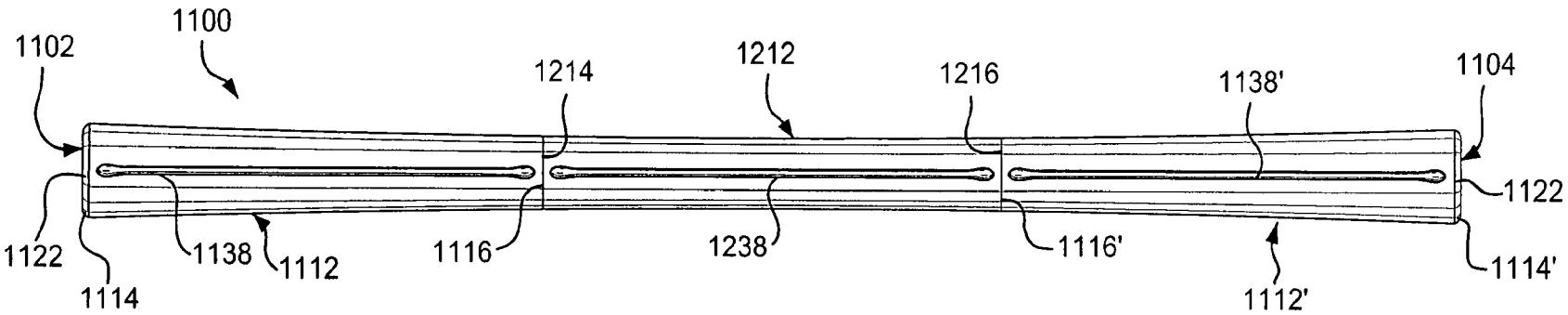
FIG. 25 is a bottom plan view of the lighting fixture according to the sixth embodiment.

In other embodiments of the invention, the light fixture assembly is constructed from a plurality of sections coupled together end-to-end to obtain the desired length of the light fixture. For example, as shown in FIG. 25, the light assembly 1100 comprises at least three housings between a first end 1102 and a second end 1104. The first outer housing 1112 and second outer housing 1112' are similar to the housing illustrated in the embodiment of FIGS. 12-20 with a longitudinal dimension that is tapered from first end 1114 to second end 1116 of the first housing 1112 and first end 1114' to second end 1116' of the second housing 1112'. The middle housing 1212 has a longitudinal dimension that is not tapered from the first end 1214 to the second end 1216 with the sides being substantially parallel between the ends 1214, 1216. In this embodiment, each housing 1112, 1112', and 1212 includes a lens or cover 1138 for the shielding material. It is possible to replace the lens 1138 with a louver.

The adjoining ends between the first housing 1112, second housing 1112' and middle housing 1212 are typically coupled together by the inner end caps, as shown in FIGS. 19 and 20 and described in the previous embodiments, such that the interior ends of each housing 1112, 1112' are flush with the interior ends of each adjacent housing 1212. More than one rectangular housing 1212 can be used provided the outermost housings 1112, 1112' of the fixture 1100 are tapered from the first end 1102 to the second end 1104. The outer oval end caps 1122 are attached to the outer ends 1102, 1104 of the outermost housings 1112, 1112' as in the previous embodiments. The outer end caps 1122 can be opaque, transparent, or translucent.

Figure 26:
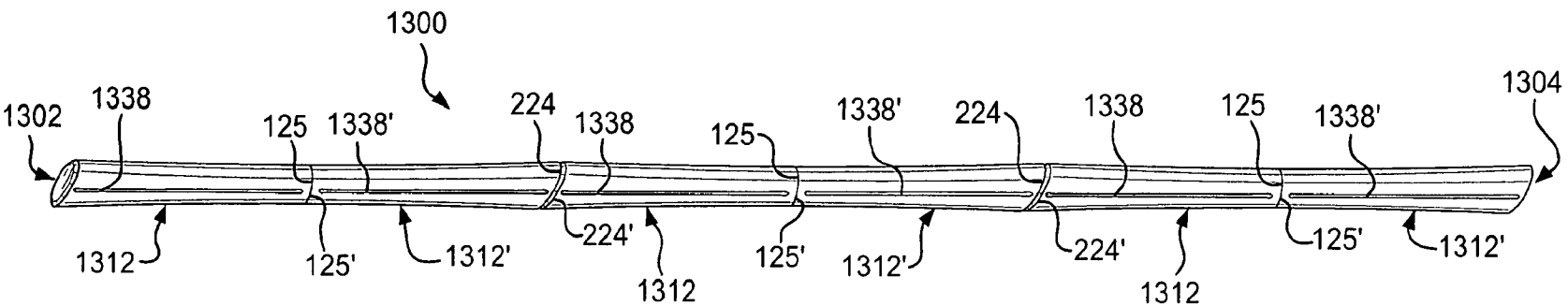
FIG. 26 is a bottom perspective view of the lighting fixture according to the seventh embodiment.

Turning to FIG. 26, an additional embodiment is illustrated where the light assembly 1300 comprises at least three housings between a first end 1302 and a second end 1304. The individual housings 1312, 1312' are similar to the housing illustrated in the embodiment of FIGS. 12-20. Light assembly 1300 includes a plurality of housings 1312, 1312' coupled together such that the entire assembly 1300 has tapered housings. In this embodiment, each housing 1312, 1312' includes a lens or cover 1338 for the shielding material. It is possible to replace the lens 1338 with a louver.

The coupling between each housing 1312, 1312' and each adjacent pair of housings 1312, 1312' is similar to that described in the embodiments of FIGS. 19-22. More particularly, the fixture 1300 incorporates the end caps 125, 125' shown in FIGS. 19 and 20 between each flush coupling adjacent the tapered housings 1338 and 1338'. The fixture 1300 incorporates the end cap shown in FIGS. 21 and 22 between each of the scalloped end caps 222, 222'. With this configuration, semi-direct lighting is emitted from the interior portion of the lighting assembly 1300 and the outermost ends 1302, 1304.

While particular embodiments have been chosen to illustrate the invention, it will be understood by those skilled in the art that various changes and modifications can be made therein without departing from the scope of the invention as defined in the appended claims.

What is claimed is:

1. A lighting fixture comprising:

an elongated opaque housing having a first longitudinal end and second longitudinal end, said housing having an open top for emitting light and a reflector pan for directing light in an upward direction, said reflector pan having a bottom wall with an opening therein for emitting light in a downward direction;

a lamp positioned in said housing;

a first inner end cap coupled to said first end and a second inner end cap coupled to said second end of said housing, said first inner end cap defining an end cap opening for allowing light to pass through said first longitudinal end;

a light emitting member coupled to said first inner end cap closing said first longitudinal end of said housing and for receiving light from said end cap opening for emitting light from said lamp.

2. A lighting fixture according to claim 1, wherein said light emitting member is translucent or transparent to emit a portion of the light from said lamp.

3. A lighting fixture according to claim 1, wherein said light emitting member is an outer end cap coupled to said first inner end cap of said housing, and has an opaque center portion and a transparent or translucent ring-shaped outer edge, whereby only said outer edge is illuminated by said lamp.

4. A lighting fixture according to claim 1, wherein said opening has a length and width less than a length and width of said open top.

5. A lighting fixture comprising:

an elongated housing having an open top, first and second longitudinal ends, at least one lamp received therein, and an outer shell forming an outer surface enclosing said housing;

a reflector pan positioned in said housing below said lamp for directing light upwardly through said open top;

a light emitting end cap coupled to said first end of said housing, adapted to emit light from said at least one lamp in a radially outward direction from a top, bottom first side and second side of said lighting fixture; and a longitudinal slot in a bottom surface of said reflector pan and a longitudinal slot in said outer shell of said housing adapted to emit light therefrom in a downward direction, said longitudinal slots having a width less than a width of said open top, and where the amount of light emitted from said open top is greater than the amount of light emitted through said slot.

6. A lighting fixture according to claim 5, wherein said outer shell is opaque.

7. A lighting fixture according to claim 5, wherein said light emitting end cap includes an outer translucent peripheral edge adapted to provide semi-direct light and an opaque end wall.

8. A lighting fixture according to claim 5, wherein said outer shell comprises a first shell and a second shell having at least one attachment member for coupling said first and second shells together.

9. A lighting fixture according to claim 5, wherein said lighting fixture has a substantially elliptical cross section and tapers towards one end of said lighting fixture.

10. A lighting fixture according to claim 5, wherein a second end cap is coupled to said second end of said housing, adapted to emit light from said at least one lamp.

11. A lighting fixture according to claim 5, wherein a louver is positioned in said longitudinal slot of said outer shell adapted to emit light therefrom.

12. A lighting fixture assembly comprising:

a first elongated housing having an open top, first and second longitudinal ends, at least one lamp received in said housing, and an opaque outer shell coupled to and enclosing said housing and extending between said first and second ends with an opening along a bottom surface, said lamp emitting light from said open top and said opening in said outer shell;

a second elongated housing having an open top, first and second longitudinal ends, at least one lamp received in said housing, and an opaque outer shell coupled to and enclosing said housing and extending between said first and second ends with an opening along a bottom surface of said outer shell, said lamp emitting light from said open top and opening in said outer shell, and said first end of said first housing being coupled to said first end of said second housing; and a first translucent end cap member disposed at said second end of said first housing and closing said second end of said first housing and a second translucent end cap member disposed at said second end of said second housing and closing said second end of said second housing, said first and second translucent end cap members emitting light from said at least one lamp in a radial direction around said first and second housings.

13. A lighting fixture according to claim 12, wherein each of said housings have a substantially elliptical-shaped cross section and is tapered towards the center of said assembly.

14. A lighting fixture according to claim 12, wherein said opening in said outer shell defines a longitudinal slot.

15. A lighting fixture according to claim 14, wherein said slot includes a shielding material with a predetermined degree of light translucence.

16. A lighting fixture according to claim 12, wherein said first and second translucent end cap members, respectively, having a predetermined degree of translucence.

17. A lighting fixture according to claim 12, wherein each of said first and second translucent end cap members have an opaque center portion to define a translucent outer ring for emitting light in a radially outward direction.

18. A lighting fixture according to claim 12, wherein a louver is positioned in said opening of said outer shell and extends between said first and second ends of each of said housings.

19. A lighting fixture according to claim 18, wherein said louver includes a shielding material with a predetermined degree of translucence.

20. The light fixture of claim 12, wherein said outer shell comprises a first shell and a second shell coupled together and where said opening in said bottom surface is formed between said first shell and second shell.

21. The lighting fixture of claim 1, wherein said first inner end cap includes a mounting portion adapted for coupling to a hanger to support said light fixture.

22. The lighting fixture of claim 21, wherein said light emitting member has a projecting member extending inwardly from an inner face, and said first inner end cap has an aperture receiving said projecting member and coupling said light emitting member to said first inner end cap.

23. The lighting fixture of claim 22, wherein said light emitting member has an outer peripheral edge coupled to an outer edge of said housing to prevent light from leaking between said light emitting member and said housing.

24. The lighting fixture of claim 1, wherein said housing has a bottom wall with a longitudinal opening aligned with said opening in said reflector pan, said bottom wall being spaced from said reflector pan;

a first ballast cover and a second ballast cover extending between said reflector pan and bottom wall of said housing to define a channel; and a louver assembly adjacent to said channel.

25. The lighting fixture of claim 24, further comprising an outer shell enclosing said housing and having said longitudinally extending opening aligned with said channel, and where said light emitting member has an outer peripheral edge coupled to said outer shell to close said outer shell.

26. The lighting fixture of claim 5, further comprising a first inner end cap coupled to said first end of said housing; and a second inner end cap coupled to said second end of said housing, each said end cap having a coupling portion for coupling with a hanger to suspend said light fixture.

27. The lighting fixture of claim 26, wherein said first inner end cap defines an opening into said housing to allow light within said housing to pass to said light emitting end cap.

28. The lighting fixture of claim 27, wherein said light emitting end cap has an opaque end wall.

29. The lighting fixture of claim 27, wherein said light emitting end cap has a projecting member extending from an inner face and said first inner end cap has a hole for receiving said projecting member for coupling said light emitting end cap to said first inner end cap.

30. The lighting fixture of claim 5, further comprising a ballast cover extending between said slot in said reflector pan and said slot in said outer shell to define a channel; and a louver assembly adjacent to said channel.

31. The lighting fixture of claim 12, further comprising a first inner end cap coupled to and substantially closing said first end of said first housing, said first inner end cap having at least one opening adapted for feeding electrical wiring; and a first inner end cap coupled to and substantially closing said first end of said second housing, said first inner end cap having at least one opening adapted for feeding electrical wiring, said first inner end cap of said second housing being coupled to said first inner end cap of said first housing.

32. The lighting fixture of claim 31, wherein said first inner end cap of said first housing has a sleeve extending from an outer face thereof and encircling said opening, said sleeve being received in said opening in said first inner end cap of said second housing for feeding wire between said first and second housings.

33. The lighting fixture of claim 31, further comprising a third translucent end cap coupled to said first inner end cap of said first housing, said third translucent end cap having an outer peripheral edge coupled to said outer shell and having an opening aligned with said opening in said first inner end cap; and a fourth translucent end cap coupled to said second inner end cap of said second housing, said fourth end cap having an outer peripheral edge coupled to said outer shell and having an opening aligned with said opening in said inner end cap;

said third and fourth end caps receiving light from said lamps for emitting light radially outward between opaque outer shells.

34. The lighting fixture of claim 33, further comprising a fastener extending through said openings in said third and fourth translucent end caps and coupled to said first and second inner end caps together.

35. The lighting fixture of claim 12, wherein said first housing has a bottom wall with said opening formed therein, said first housing further comprising:

a reflector pan coupled to said first housing and having a longitudinal slot formed therein and aligned with said opening in said shell;

a ballast cover extending between said opening in said bottom wall of said reflector pan and said opening in said shell to form a light channel.

* * * * *